US008172917B2

(12) United States Patent
Kup et al.

(10) Patent No.: US 8,172,917 B2
(45) Date of Patent: May 8, 2012

(54) APPARATUS FOR THE PURIFICATION OF GAS WHILE BLEEDING A CRANK HOUSING

(75) Inventors: Serge Kup, Nykvarn (SE); Mats-Orjan Pogen, Billegerga (SE); Ingvar Hallgren, Tumba (SE)

(73) Assignee: Alfa Laval Tumba AB, Tumba (SE)

( * ) Notice: Subject to any disclaimer, the term of this patent is extended or adjusted under 35 U.S.C. 154(b) by 887 days.

(21) Appl. No.: 11/914,113

(22) PCT Filed: May 2, 2006

(86) PCT No.: PCT/EP2006/004098

§ 371 (c)(1),
(2), (4) Date: May 14, 2008

(87) PCT Pub. No.: WO2006/119890

PCT Pub. Date: Nov. 16, 2006

(65) Prior Publication Data

US 2008/0256912 A1 Oct. 23, 2008

(30) Foreign Application Priority Data

May 9, 2005 (DE) ..... 10 2005 021 278

(51) Int. Cl.
*B01D 45/14* (2006.01)

(52) U.S. Cl. ..... 55/406; 55/DIG. 19; 277/417; 277/419; 95/270

(58) Field of Classification Search ..... 95/270; 123/41.86; 277/345, 411, 412, 417, 419, 277/422; 55/355, 385.1, 400, 404, 405, 406, 55/428, 434, DIG. 19
See application file for complete search history.

(56) References Cited

U.S. PATENT DOCUMENTS 5,954,035 A 9/1999 Hofer et al.
(Continued)

FOREIGN PATENT DOCUMENTS

CN 2148858 Y 12/1993
(Continued)

OTHER PUBLICATIONS

Chinese Office Action dated Apr. 3, 2009, issued in corresponding Chinese Patent Application No. 200680016067.8.
International Search Report mailed Jul. 20, 2006 in International Application No. PCT/EP2006/004098.

*Primary Examiner* — Duane Smith
*Assistant Examiner* — Sonji Turner
(74) *Attorney, Agent, or Firm* — Westerman, Hattori, Daniels & Adrian, LLP

(57) ABSTRACT

The invention relates to an apparatus (10) for purifying gas while bleeding a crank housing, said apparatus (10) comprising a housing (12) inside which a separator chamber (14) is provided, a rotor arrangement with a rotor shaft (32) that is rotatably mounted in the housing and a centrifugal rotor (39) located in the separator chamber (14), and a fluid driving device (64) for driving the rotor shaft (32) by means of a driving fluid, the driving device (64) being disposed in a driving chamber (60) that is separated from the separator chamber (14) by means of a housing partition (16), and the rotor shaft (32) extending through a breakthrough in the housing partition (16). In the case of this device, it is provided that a labyrinth-type seal (70) is provided in the zone of the breakthrough in order to seal the driving chamber (60) from the separator chamber (14).

19 Claims, 2 Drawing Sheets

U.S. PATENT DOCUMENTS

| | | | | |
|---|---|---|---|---|
| 6,155,574 | A | 12/2000 | Borgstrom et al. | |
| 6,676,131 | B1 | 1/2004 | Hedin | |
| 7,033,411 | B2 | 4/2006 | Carlsson et al. | |
| 7,338,546 | B2 * | 3/2008 | Eliasson et al. | 55/406 |
| 7,465,341 | B2 * | 12/2008 | Eliasson | 96/281 |
| 2004/0107681 | A1 | 6/2004 | Carlsson et al. | |
| 2007/0249479 | A1 * | 10/2007 | Eliasson et al. | 494/43 |

FOREIGN PATENT DOCUMENTS

| | | | |
|---|---|---|---|
| EP | 0 933 507 | B1 | 9/2002 |
| GB | 911 384 | A | 11/1962 |
| SE | 519 180 | C2 | 1/2003 |
| WO | 03/061838 | A1 | 7/2003 |
| WO | 2004/091799 | A1 | 10/2004 |

* cited by examiner

APPARATUS FOR THE PURIFICATION OF GAS WHILE BLEEDING A CRANK HOUSING

SUBJECT AREA OF THE INVENTION

This invention relates to an apparatus for purifying gas while bleeding a crank housing, said apparatus comprising a housing inside which a separator chamber is provided, a rotor arrangement with a rotor shaft that is rotatably mounted in the housing and a centrifugal rotor located in the separator chamber, and a fluid driving device for driving the rotor shaft by means of a driving fluid, the driving device being disposed in a driving chamber that is separated from the separator chamber by means of a housing partition, the rotor shaft extending through a breakthrough in the housing partition, and a labyrinth-type seal being provided in the zone of the breakthrough in the housing partition in order to seal the driving chamber from the separator chamber.

PRIOR ART

Such an apparatus is known from the prior art. The document WO 2004/091799 A1 shows a corresponding apparatus, using which oil particles of an oil-air mixture coming from an internal combustion engine are separated out by means of a centrifugal rotor. The centrifugal rotor has a group of separator plates which are in the form of truncated cones, arranged in a stack at regular intervals on the rotor shaft, and connected to it in a torque-proof manner. In their central zone, the separator plates are provided with breakthroughs which are aligned with each other. Between the separator plates, conically running outflow zones, which open into a radially outer zone of the separator chamber, are formed. The rotor shaft and thus the centrifugal rotor are driven via a turbine wheel, which is arranged in the driving chamber and struck by an oil jet in the case of operation. Because of the rotational movement of the centrifugal rotor, the oil-gas mixture which is introduced into its central zone by the internal combustion engine is set into rotation and conveyed radially outward. It flows through the conically running outflow zones. The oil particles which are contained in the oil-gas mixture separate out on the separator plates. Also, because of the partial vacuum which occurs in the central zone, more oil-gas mixture is sucked from the internal combustion engine. The oil which is separated out on the separator plates, because of its rotational movement and the resulting centrifugal forces, is also conveyed radially outward, and finally flung from the radially outer edges of the separator plates onto the housing wall which delimits the separator chamber. From this, because of gravity, the separated-out oil flows down into a collection channel, and is fed via an outlet opening back to the oil circuit of the internal combustion engine.

In the above prior art, the requirement that the separator chamber must be separated from the driving chamber with as tight a seal as possible is explained. In particular, when the turbine wheel is driven, oil droplets which form in the driving chamber should be prevented from entering the separator chamber and recontaminating the air which has previously been freed from oil particles. For this purpose, it is provided that a bearing, which is received in the housing partition and which carries the rotor shaft rotatably, is made as fluidproof and gasproof as possible by a contacting washer seal. However, it has been shown that as the operating duration increases, the washer seal is subject to some wear, and thus its sealing effect decreases. Additionally, this prior art provides that between the separator chamber and the driving chamber, an oil collection chamber is provided. However, in certain operating situations a large pressure increase can occur in the separator chamber, in which case, because of the intermediately connected oil collection chamber and the contacting seal washer, the pressure cannot be relieved to the driving chamber. Consequently, oil-gas mixture escapes via the outlet opening out of the separator chamber into the oil collection chamber, so that temporarily no more separated-out oil can flow out of the separator chamber. This affects the operation of the apparatus.

A sealing ring for a centrifugal separating apparatus is known from U.S. Pat. No. 6,676,131. This has advantages regarding assembly and good fixing in a groove, which receives the sealing ring.

Another separating apparatus is known from US 2004/0107681 A1. In this prior art too, the centrifugal rotor is driven via a turbine wheel with an oil jet. However, the turbine wheel is provided directly in the separator chamber, so that the oil droplets which result when the oil jet strikes the turbine wheel additionally contaminate the oil-gas mixture which is to be purified.

Also, from WO 03/061838, a separating apparatus with which a sealing means such as a labyrinth seal can be provided is known. The apparatus is received in the upper chamber of a housing which is divided into two by a partition. The oil-gas mixture is fed via an opening in the lower chamber of the housing, and through it reaches the upper chamber and the separating apparatus via a central opening in the housing partition. The driving chamber is received in the lower chamber, and separated from the oil-gas mixture which flows into the lower chamber. To achieve a desired suction effect at the opening of the housing partition, and in this way to convey the oil-gas mixture into the separator chamber of the separating apparatus, the intermediate space between the partition and the end wall of the separating apparatus facing it must not be too large. For this reason, a labyrinth seal can additionally be provided at this location, which however with appropriate dimensioning of the intermediate space between the partition and the end wall of the separating apparatus facing it is unnecessary and undesirable, since it can prevent the feeding of the oil-gas mixture.

Finally, the document EP 0 933 507 B1 shows a separating apparatus in which the centrifugal rotor is driven via a chain drive.

OBJECT AND SOLUTION ACCORDING TO THE INVENTION

It is the object of this invention to provide an apparatus of the initially designated type which, with simple and inexpensive construction, provides a sufficiently fluidproof seal between separator chamber and driving chamber, but makes it possible to equalize pressure between these chambers.

This object is achieved by an apparatus of the initially designated type in which the housing partition has a pipe socket, which projects to the driving chamber and the purpose of which is to implement the labyrinth seal.

It has been recognised that a contactless labyrinth seal is enough to prevent the oil droplets which occur in the driving chamber from penetrating into the separator chamber. However, the use of a contactless labyrinth seal has the advantage, compared with the solution which is described in the prior art according to WO 2004/091799 A1, that in operating states with high pressure in the separator chamber, pressure can be equalized between the driving chamber and the separator chamber through the gap of the labyrinth seal. Undesired "blocking" of the oil outlet opening is thus avoided, so that oil can continue to flow out of the separator chamber even while the pressure is being equalized. Consequently, more reliable operation of the apparatus according to the invention compared with the prior art can be achieved.

In an advantageous embodiment of the invention, it is provided that the pipe socket includes a bearing bush, in which a bearing, in particular a ball bearing, is received to carry the rotor shaft. In relation to this, it can also be provided that the bearing bush is integrated in the housing partition. This pipe socket can advantageously be used to implement the labyrinth seal. Thus a further development of the invention provides that the labyrinth seal has a sealing washer with a surrounding axial groove, and that a free end of the pipe socket engages with the axial groove, preferably without contact. Also, in the case of this implementation variant of the invention, it can be provided that the sealing washer is connected to the rotor shaft so that it can rotate. In this embodiment of the invention, therefore, the labyrinth seal is formed between the pipe socket, which is fixed to the housing, and the rotating rotor shaft. The invention thus avoids sealing parts which rotate relative to each other in operation with a contact seal which is liable to wear.

An embodiment of the invention provides that the driving device has a driving wheel which can be driven by fluid, preferably a turbine wheel which is struck by fluid, and which is attached to the rotor shaft in a torque-proof manner and connected to the sealing washer. However, it is equally possible to use other kinds of driving devices, e.g. a chain drive running in an oil bath or similar.

If a driving wheel is used, a further development of the invention provides that the sealing washer is arranged between the driving wheel and the bearing. In this design embodiment of the invention, it can also be provided that the sealing washer has a radial zone of greater thickness, which contacts an inner ring of the bearing. In this way, the sealing washer can also be used to brace the bearing.

The invention also concerns a seal arrangement for an apparatus of the type described above, comprising a labyrinth seal which seals the separator chamber from the driving chamber without contact.

BRIEF DESCRIPTION OF THE DRAWINGS

The invention is explained below using an example and on the basis of the attached figures.

DESCRIPTION OF AN EMBODIMENT ACCORDING TO THE INVENTION

Figure 1:
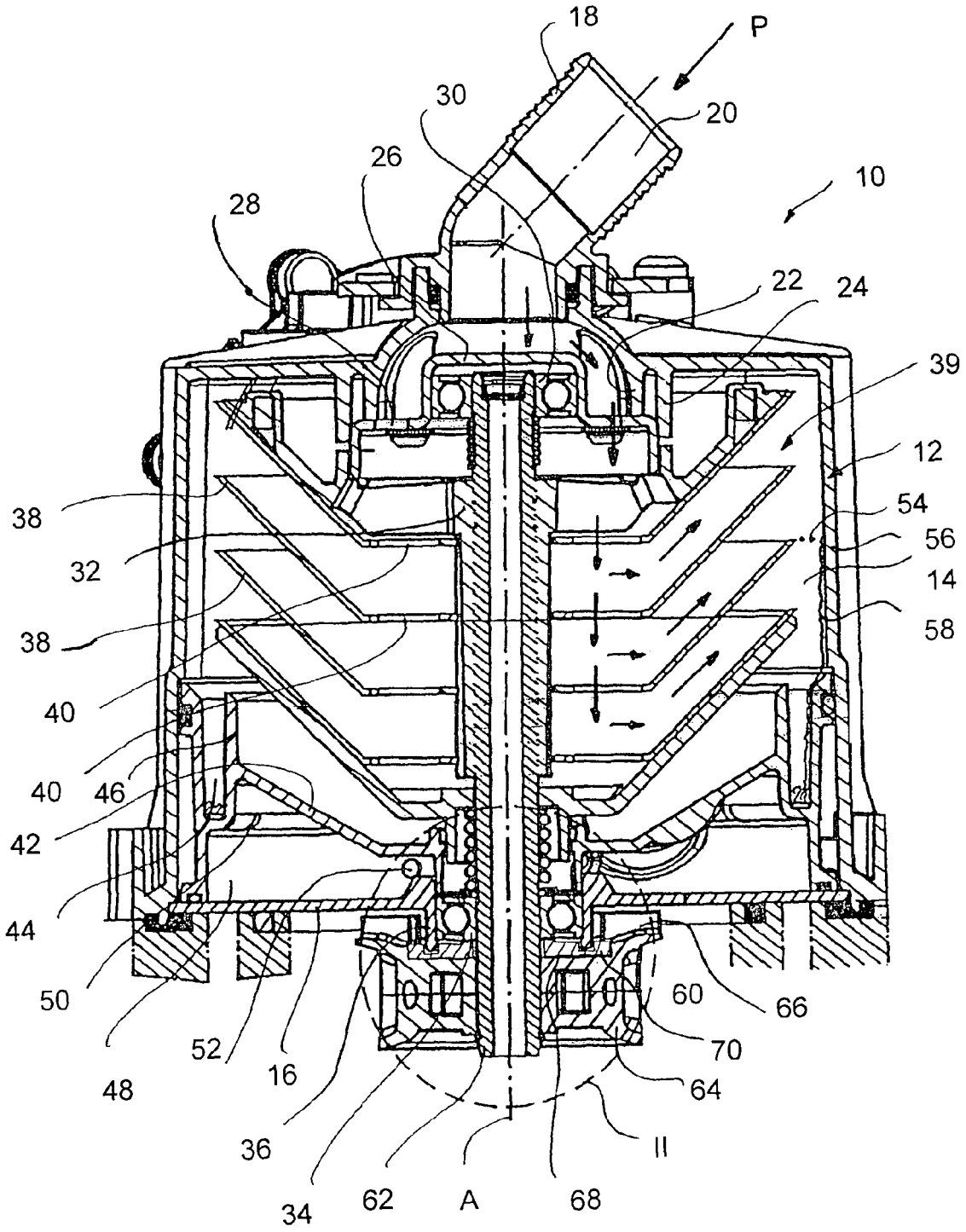
FIG. 1 shows a cross-section of an apparatus according to the invention, including the axis.

In FIG. 1, a centrifugal separating apparatus according to the invention is shown in a cross-section which includes the longitudinal axis A, and designated as a whole with 10. The separating apparatus 10 includes a housing 12, which encloses a separator chamber 14. The housing 12 is in open form downward, and sealed by a floor-side housing partition 16. In the upper zone, the housing is provided with an inlet nozzle 18, which defines an inlet 20 which opens into the separator chamber 14. In its lower zone, the housing 12 also has an outlet (not shown). Near the inlet 20, the housing 12 has holding fins 22 and 24, which receive a bearing cup 26 and hold it in the housing 12. The bearing cup 26 is in stepped form, and includes breakthroughs 28, so that the inlet 20 is connected to the separator chamber 14 for fluid.

In the bearing cup 26, a ball bearing 30 with its outer ring is received in a torque-proof manner. The inner ring of the ball bearing 30 is pressed onto a rotor shaft 32. The rotor shaft 32 is also carried via a further ball bearing 34 in the housing partition 16. For this purpose, the housing partition 16 has a central breakthrough, which is surrounded by an integrally formed pipe-shaped socket 36. The ball bearing 34 is pressed with its outer ring into the inner circumferential surface of the pipe socket 36, and at its lower end is held on the socket 36 by a diameter narrowing. On the other hand, the inner ring of the ball bearing 34 rests on the rotor shaft 32.

Between the two ball bearings 30 and 34, on the rotor shaft 32 multiple separator plates 38 in the form of truncated cones are arranged at regular intervals, and attached in a torque-proof manner. The separator plates 38 also each have breakthroughs 40 in their horizontally running central zone. The rotor shaft 32 and separator plates 38 together form a centrifugal rotor 39.

Also, in the housing 12, a floor part 42 is arranged, with a collection channel 44 which is formed integrally in it. The collection channel 44 is delimited on its radially inner side by a surrounding channel wall 46, which is formed on the funnel floor 42. Thus between the floor part 42 and the housing partition 16, an oil collection basin 48 is formed. The collection channel 44 is connected to the oil collection basin 48 via floor-side outflow slits 50, which are evenly distributed in the circumferential direction. In the oil collection basin 48, an outflow opening 52 to take the oil away is provided.

Below the housing partition 16, a driving chamber 60 (only partly shown) is arranged. The rotor shaft 16 extends through the pipe socket 36 into the driving chamber 60. At its free end 62, a driving wheel in the form of a turbine wheel 64 is attached in a torque-proof manner. The turbine wheel 64 has at its upper end turbine blades 66, which can be struck by an oil jet via a nozzle (not shown in FIGS. 1 and 2), so that the oil which strikes the turbine blades 66 sets the turbine wheel 64 and thus the rotor shaft 16, with the separator plates 38 which are attached to it, into rotation around the axis A. Details of arrangement in the zone of the lower ball bearing 34 follow from FIG. 2.

Figure 2:
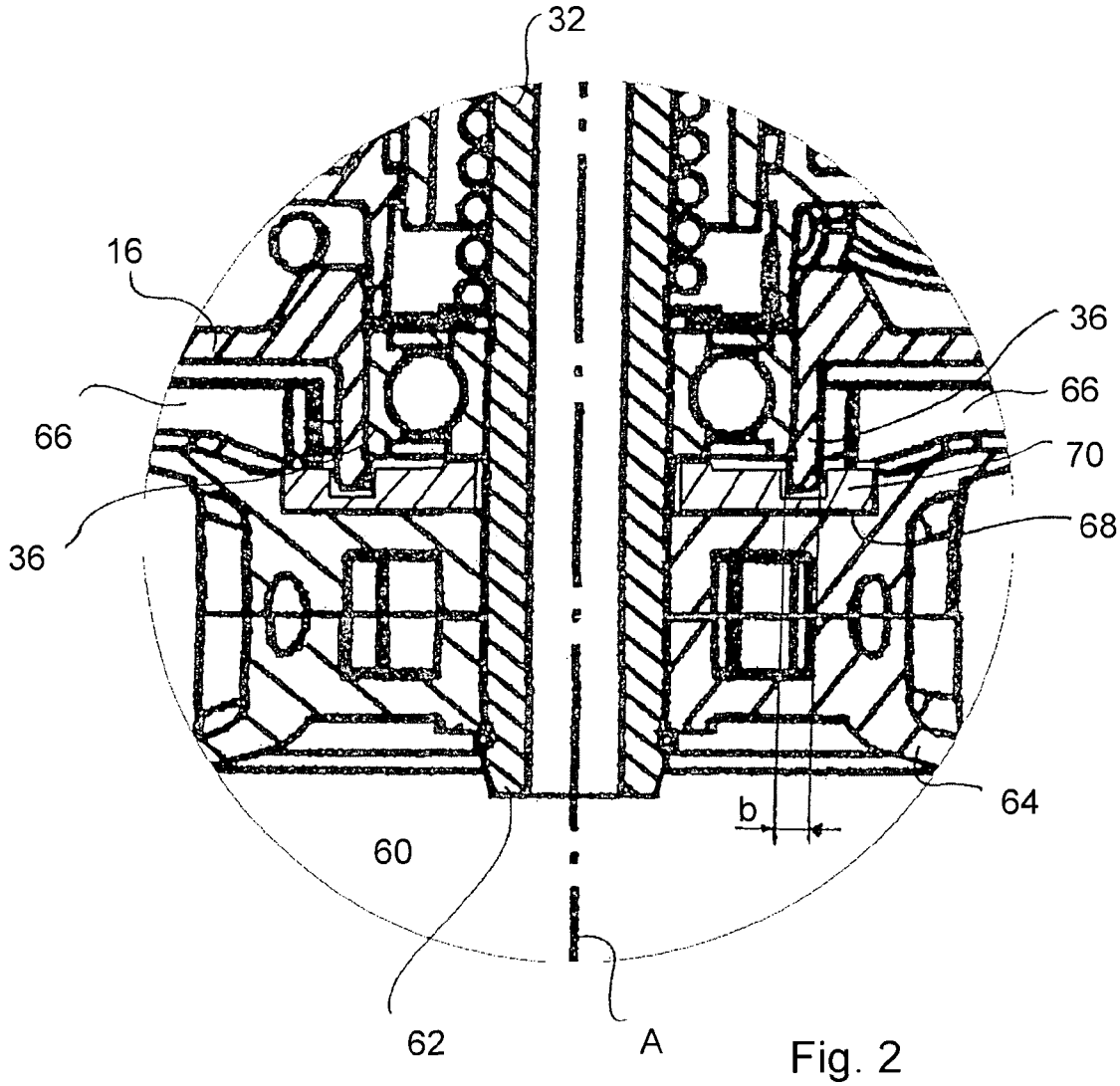
FIG. 2 shows an enlarged representation of the zone marked with II in FIG. 1.
Figure 3:
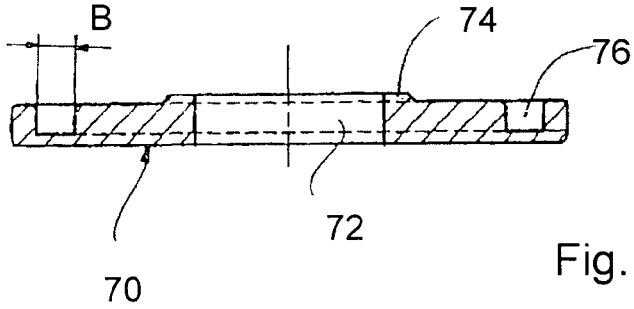
FIG. 3 shows a cross-section through a seal washer according to the invention.

In FIGS. 1 and 2, it is also seen that in the turbine wheel 64, at its upper end, a recess 68 is provided, and a sealing washer 70 of steel or another shape-stable material is inserted into it. The sealing washer 70 is shown in detail in FIG. 3. It has a central breakthrough 72, which is surrounded by a raised radial zone 74. The purpose of the raised radial zone 74 is to be put against the inner ring of the ball bearing 36. The underside of the sealing washer 70 is in essentially flat form. The sealing washer 70 also has a surrounding groove 76, the width B of which exceeds the wall thickness b of the lower free end of the pipe socket 36. In the assembled state, the lower free end of the pipe socket 36 extends into the groove 76 without contact, so that a labyrinth-like gap is formed between the lower free end of the pipe socket 36 and the groove 76. The gap width is in the range from 0.01 mm to 0.2 mm, for instance.

The operation of the apparatus 10 according to the invention is explained below. As previously indicated, the turbine blades 66 of the turbine wheel 64 are struck by a fluid, preferably engine oil, under pressure, so that the turbine wheel 64 is set into rotation and drives the rotor shaft 32. With the rotor shaft 32, the separator plates 38 rotate. They set the air in the central zone of the centrifugal rotor 39, which consists of the rotor shaft 32 and the separator plates 38, into rotational movement, so that it flows outward because of the centrifugal effect. The result is a partial vacuum in the central zone, and a suction effect (see arrow P), so that an oil-air mixture is sucked via the inlet nozzle 18 from a crank housing of an internal combustion engine. The oil-air mixture contains oil particles which are to be separated out of the air.

The oil-air mixture passes through the breakthroughs 28 to the separator plates 38, and is set into rotational movement there. Part of the oil-air mixture flows through the breakthroughs 40 downward. The other part of the oil-air mixture moves radially outward because of centrifugal force, and meets the conical zones of the separator plates 38. The oil droplets which are included in the oil-air mixture separate out of the air and remain stuck to the separator plates. The separated-out oil is conveyed radially outward on the separator plates 38 by the centrifugal force, and finally flung off at their radially outer edge, as shown in FIG. 1 at 54. On the housing side wall 56, a oil film 58 forms, flows downward because of gravity, and collects in the collection channel 44. From there, the separated-out oil can flow down via the outflow slits 50 into the fluid collection basin 48, and be fed back into the oil circuit of the engine. The purified air, which has been separated from the oil particles, flows out of the separator chamber 14 via the outlet (not shown) and can be discharged to the atmosphere.

In operation, relatively large quantities of oil, which is sprayed in the driving chamber when the turbine wheel 64 is driven, absolutely must be prevented from entering the zone of the collection basin 48 or the zone of the separator chamber 14. In this way the operation of the apparatus 10 would be seriously affected. For this purpose, the sealing washer 70 is provided to form the labyrinth seal. It has been shown that the use according to the invention of the sealing washer 70 with the groove 76, and the resulting contactless labyrinth seal, has considerable advantages compared with contacting seals, as shown in WO 2004/091799 A1, for instance. Firstly, as the operating duration increases, contacting seals are subject to ever increasing wear, which can even result in failure of the seal. In contrast, the labyrinth seal according to the invention functions without contact, and is therefore not subject to any wear caused by friction. Also, in certain operating situations, in particular high performance operation of the internal combustion engine, relatively high pressures or pressure peaks can occur in the separator chamber, and must be relieved in a short period. Pressure relief via the outflow slits 50 and outflow opening 52 must be avoided, since otherwise the oil outflow process would be interrupted and too much oil might remain in the separator chamber 14. The result would be deterioration of the separator effect. The invention now provides the advantage that pressure relief can take place towards the driving chamber 60 via the labyrinth seal between the sealing washer 70 and the pipe socket 36. Nevertheless, the labyrinth seal ensures that the separator chamber 14 is sufficiently well sealed from the driving chamber 60, so that oil droplets which are present in the driving chamber 60 cannot enter the separator chamber 14.

The invention claimed is:

1. Apparatus for purifying gas while bleeding a crank housing, said apparatus comprising:

a housing, inside which a separator chamber is provided, a rotor arrangement comprising a rotor shaft that is rotatably mounted in the housing and a centrifugal rotor located in the separator chamber, a fluid driving device for driving the rotor shaft by means of a driving fluid, and a labyrinth-type seal is provided in a zone of a breakthrough that is capable of sealing the driving chamber from the separator chamber, and wherein the labyrinth-type seal has a sealing washer with a surrounding axial groove, wherein the fluid driving device being disposed in a driving chamber that is separated from the separator chamber by means of a housing partition, wherein the rotor shaft extends through the breakthrough in the housing partition, and wherein the housing partition has a pipe socket, which projects to the driving chamber and which implements the labyrinth-type seal.

2. Apparatus according to claim 1, wherein the pipe socket includes a bearing bush, in which a bearing, is received to carry the rotor shaft.

3. Apparatus according to claim 2, wherein the bearing bush is integrated in the housing partition.

4. Apparatus according to claim 2, wherein the bearing is a ball bearing.

5. Apparatus according to claim 1, wherein a free end of the pipe socket engages with the axial groove.

6. Apparatus according to claim 5, the sealing washer is connected to the rotor shaft.

7. Apparatus according claim 6, wherein the fluid driving device has a driving wheel capable of being driven by fluid, and wherein the driving wheel is attached to the rotor shaft in a torque-proof manner and connected to the sealing washer.

8. Apparatus according to claim 7, wherein the driving wheel is a turbine wheel which is struck by fluid.

9. Apparatus according to claim 6, wherein a radial zone of the sealing washer has a greater thickness than the remainder of the sealing washer, and the radial zone is in contact with an inner ring of the bearing.

10. Apparatus according to claim 5, wherein the fluid driving device has a driving wheel capable of being driven by fluid, and wherein the driving wheel is attached to the rotor shaft in a torque-proof manner and connected to the sealing washer.

11. Apparatus according to claim 10, wherein the sealing washer is arranged between the driving wheel and the bearing.

12. Apparatus according to claim 10, wherein a radial zone of the sealing washer has a greater thickness than the remainder of the sealing washer, and the radial zone is in contact with an inner ring of the bearing.

13. Apparatus according to claim 10, wherein the driving wheel is a turbine wheel which is struck by fluid.

14. Apparatus according to claim 5, wherein a radial zone of the sealing washer has a greater thickness than the remainder of the sealing washer, and the radial zone is in contact with an inner ring of the bearing.

15. Apparatus according to claim 5, wherein the free end of the pipe socket engages with the axial groove of the seal washer without contact.

16. Seal arrangement for an apparatus according to claim 1, further comprising a labyrinth seal which seals the separator chamber from the driving chamber without contact.

17. Apparatus according to claim 1, wherein the pipe socket includes a bearing bush, in which a bearing, is received to carry the rotor shaft and wherein the fluid driving device has a driving wheel capable of being driven by fluid, and wherein the driving wheel is attached to the rotor shaft in a torque-proof manner and connected to the sealing washer.

18. Apparatus according to claim 17, wherein the sealing washer is arranged between the driving wheel and the bearing.

19. Apparatus according to claim 18, wherein a radial zone of the sealing washer has a greater thickness than the remainder of the sealing washer, and the radial zone is in contact with an inner ring of the bearing.

* * * * *